US008213266B2

(12) United States Patent
Kasuo et al.

(10) Patent No.: US 8,213,266 B2
(45) Date of Patent: Jul. 3, 2012

(54) ELECTRONIC TIMEPIECE

(75) Inventors: Tomoo Kasuo, Hamura (JP); Fumiaki Ochiai, Akishima (JP)

(73) Assignee: Casio Computer Co., Ltd., Tokyo (JP)

( * ) Notice: Subject to any disclaimer, the term of this patent is extended or adjusted under 35 U.S.C. 154(b) by 344 days.

(21) Appl. No.: 12/551,746

(22) Filed: Sep. 1, 2009

(65) Prior Publication Data

US 2010/0061193 A1 Mar. 11, 2010

(30) Foreign Application Priority Data

Sep. 11, 2008 (JP) ..... 2008-233174

(51) Int. Cl.

| | |
|---|---|
| ***G04C 11/02*** | (2006.01) |
| ***G04C 13/02*** | (2006.01) |
| ***G04C 23/00*** | (2006.01) |
| ***G04C 19/00*** | (2006.01) |
| ***G04B 1/00*** | (2006.01) |

(52) U.S. Cl. ..... 368/47; 368/48; 368/66; 368/80; 368/204

(58) Field of Classification Search ..... 368/47, 368/48, 64, 66, 80, 203, 204
See application file for complete search history.

(56) References Cited

U.S. PATENT DOCUMENTS

| | | | | |
|---|---|---|---|---|
| 4,041,691 | A * | 8/1977 | Chihara et al. | 368/66 |
| 4,219,999 | A * | 9/1980 | Ichikawa et al. | 368/66 |
| 4,690,568 | A * | 9/1987 | Odagiri et al. | 368/204 |
| 6,061,304 | A * | 5/2000 | Nagata et al. | 368/66 |
| 6,144,621 | A * | 11/2000 | Sase | 368/204 |
| 6,580,665 | B1 | 6/2003 | Kamiyama et al. | |
| 6,816,439 | B1 * | 11/2004 | Kawahara et al. | 368/64 |
| 7,079,451 | B2 | 7/2006 | Okeya | |
| 7,154,816 | B2 | 12/2006 | Igarashi et al. | |
| 7,161,874 | B2 | 1/2007 | Ichikawa et al. | |
| 2004/0037172 | A1 | 2/2004 | Okeya | |

(Continued)

FOREIGN PATENT DOCUMENTS

EP 1 026 559 A1 8/2000

(Continued)

OTHER PUBLICATIONS

Japanese Office Action dated Jul. 6, 2010 and English translation thereof, issued in counterpart Japanese Application No. 2008-233174.

(Continued)

*Primary Examiner* — Vit Miska
(74) *Attorney, Agent, or Firm* — Holtz, Holtz, Goodman & Chick, PC

(57) ABSTRACT

An electronic timepiece, comprises a timing section to perform timing of time based on an oscillation signal; an electric wave receiving section to receive an electric wave; a voltage detecting section to detect a power source voltage supplied from a power source section; and a stop control section to stop a receiving function of the electric wave receiving section and continue a timing operation of the timing section when the voltage detecting section detects that the power source voltage becomes lower than a first level range, and then to stop the timing operation of the timing section when a warning period for urging a user to perform the power generation by the power generating section elapsed in a state where the power source voltage is lower than the first level range without changing to a lower level than a second level range lower than the first level range.

11 Claims, 9 Drawing Sheets

U.S. PATENT DOCUMENTS

| | | | | |
|---|---|---|---|---|
| 2004/0100870 | A1 * | 5/2004 | Igarashi et al. | 368/66 |

FOREIGN PATENT DOCUMENTS

| | | | |
|---|---|---|---|
| EP | 1 213 627 | A1 | 6/2002 |
| EP | 1 321 834 | A1 | 6/2003 |
| JP | 11-223684 | A | 8/1999 |
| JP | 2002-250782 | A | 9/2002 |
| JP | 2003-057366 | A | 2/2003 |
| JP | 2004-020214 | A | 1/2004 |
| JP | 2005-308396 | A | 11/2005 |
| JP | 3738334 | B2 | 11/2005 |
| JP | 2005-331461 | A | 12/2005 |
| JP | 2006-214981 | A | 8/2006 |

OTHER PUBLICATIONS

Partial European Search Report dated Sep. 30, 2010 (in English) in counterpart European Application No. 09167760.9.

Extended European Search Report (EESR) dated Jan. 20, 2011 (in English) in counterpart European Application No. 09167760.9.

* cited by examiner

ELECTRONIC TIMEPIECE

CROSS-REFERENCE TO RELATED APPLICATIONS

This application is based on and claims the benefit of priority from the prior Japanese Patent Application No. 2008-233174, filed on Sep. 11, 2008, and including specification, claims, drawings and summary, the entire contents of which are incorporated herein by reference.

BACKGROUND OF THE INVENTION

1. Field of the Invention

The present invention relates to an electronic timepiece equipped with a power generating section and an electric wave receiving section.

2. Related Art

An electronic timepiece performing power generation by means of a solar panel and an electronic timepiece performing power generation by absorbing rocking or a body temperature have been known before. Moreover, also an electronic timepiece performing a time amendment automatically by receiving a standard wave including a time code has been known.

In an electronic timepiece having a power generation function, the power source voltage thereof falls to make various functional operations in executable when no power generation has been performed for a long period, or the functional operations, which have once stopped, again become executable state after that by the execution of power generation. Accordingly it is necessary to perform suitable control so that function stopping and function reopening can be performed normally at the time of a fall of a power source voltage and the time of a recovery of electric power.

Techniques of performing various controls at the time of a fall of a power source voltage and the recovery of electric power in an electronic timepiece having a power generation function have been hitherto proposed.

The present invention provides an electronic timepiece capable of avoiding a great fall of a power source voltage to prevent great consumption of the charged quantity of a secondary battery by liming power consumption to be less at the time of a fall of the power source voltage.

SUMMARY OF THE INVENTION

One of the preferable aspects of the present invention is an electronic timepiece comprising:

a timing section to perform timing of time based on an oscillation signal;

a time display section to display the time based on the timing of the timing section;

an electric wave receiving section to receive an electric wave including a time code;

a power source section to supply electric power to each of the sections;

a power generating section to accumulate electric power in the power source section by performing power generation;

a voltage detecting section to detect a power source voltage supplied from the power source section; and a stop control section to stop a receiving function of the electric wave receiving section and continue a timing operation of the timing section when the voltage detecting section detects that the power source voltage becomes lower than a first level range, and then to stop the timing operation of the timing section when a warning period for urging a user to perform the power generation by the power generating section elapsed in a state where the power source voltage is lower than the first level range without changing to a lower level than a second level range lower than the first level range.

Moreover, another preferable aspect of the present invention is an electronic timepiece comprising:

a timing section to perform timing of time based on an oscillation signal;

a time display section to display the time based on the timing of the timing section;

an electric wave receiving section to receive an electric wave including a time code;

a power source section to supply electric power to each of the sections;

a power generating section to accumulate electric power in the power source section by performing power generation;

a voltage detecting section to detect a power source voltage supplied from the power source section;

a stop control section to stop a display operation of the time of the time display section and a receiving function of the electric wave receiving section when the voltage detecting section detects that the power source voltage becomes lower than a first level range, and to stop a timing operation of the timing section when the power source voltage becomes lower than a second level range lower than the first level range; and a start control section to perform (i) reopening of the display operation of the time of the time display section and the receiving function of the electric wave receiving section when the voltage detecting section detects that the power source voltage becomes higher than the first level range without changing to a lower level than the second level range lower than the first level range while being lower than the first level range, and (ii) reopening of the timing operation of the timing section when the voltage detecting section detects that the power source voltage becomes higher than the second level range from a level lower than the second level range, and then reopening of the display operation of the time display section and making the electric wave receiving section receive the electric wave by the start control section when the power source voltage becomes higher than the first level range.

DETAILED DESCRIPTION OF THE PREFERRED EMBODIMENTS

In the following, the preferred embodiments of the present invention will be described with reference to the attached drawings.

First Embodiment

Figure 1:
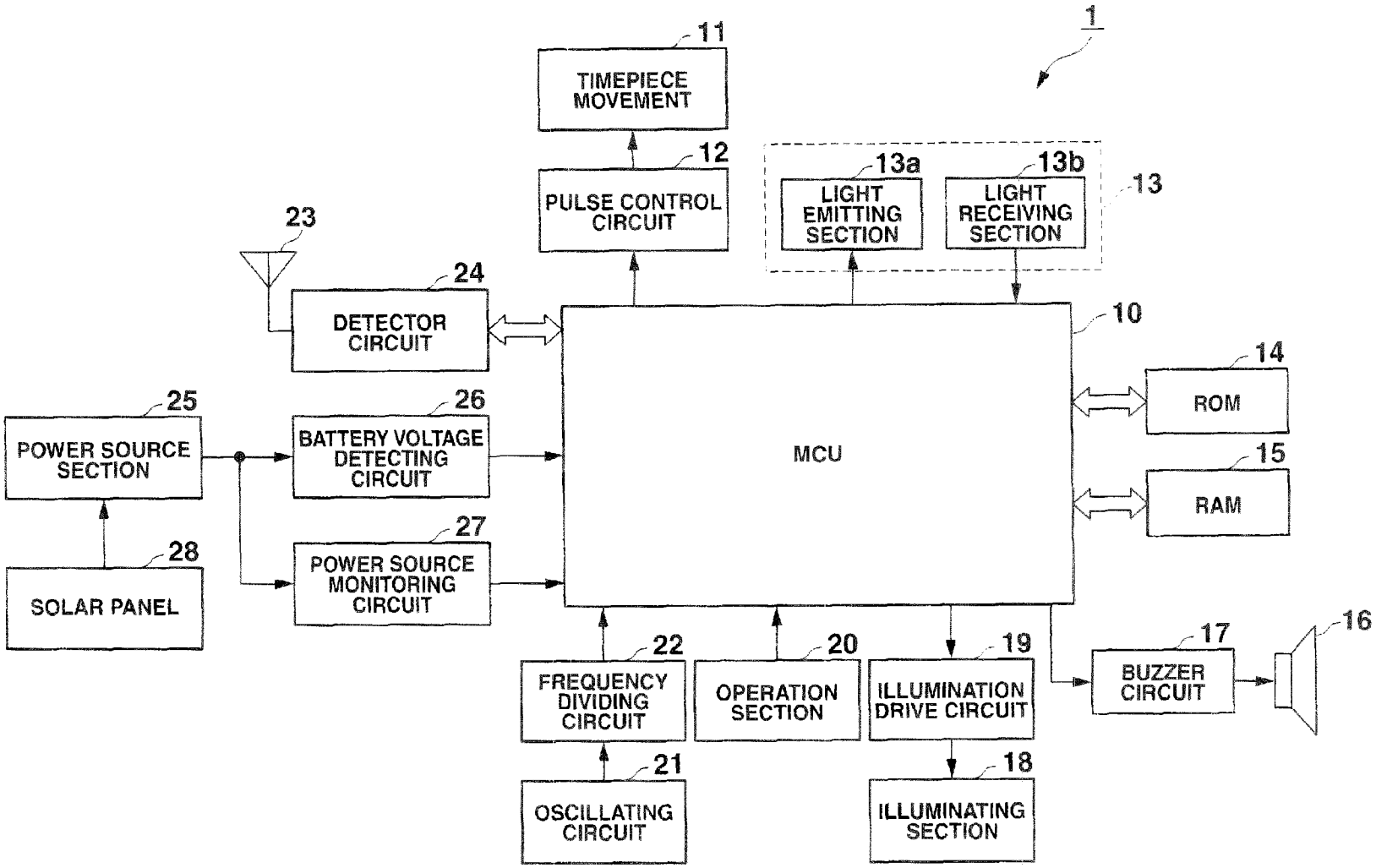
FIG. 1 is a block diagram showing the internal configuration of an electronic timepiece of a first embodiment of the present invention.

FIG. 1 is a block diagram showing the internal configuration of an electronic timepiece of a first embodiment of the present invention.

The electronic timepiece 1 of the first embodiment is, for example, the main body of a wrist watch having an analog display section to display time by rotating a plurality of hands as a time display section. The electronic timepiece 1 is equipped with a microcomputer 10 to perform the overall control of the apparatus, a timepiece movement 11 to have step motors and gear mechanisms to perform rotation drives of the plurality of hands, a pulse control circuit 12 to perform the drive control of the step motors of the timepiece movement 11, a detecting section 13 to detect hand positions, a read only memory (ROM) 14 to store control data and control programs, a random access memory (RAM) 15 to provide a working memory space to the CPU of the microcomputer 10, a speaker 16 and a buzzer circuit 17 to perform outputting of an alarm sound and the like, an illuminating section 18 and a illumination drive circuit 19 to illuminate a number plate, an operation section 20 to include a plurality of operation buttons to receive an operation input from a user, an oscillating circuit 21 to generate a predetermined frequency signal, a frequency dividing circuit 22 to divide the frequency of an oscillation signal to generate a timing frequency signal, a receiving antenna 23 to receive an electric wave including a time code, a detector circuit 24 to detect the time code from the received electric wave, a power source section 25 to have a secondary battery to supply a power source voltage to each section, a battery voltage detecting circuit 26 to perform detecting processing of the battery voltage of the secondary battery as the power source voltage, a power source monitoring circuit 27 to monitor the battery voltage of the secondary battery to perform the reset control of the microcomputer 10, a solar panel 28 to receive a light from the outside to perform power generation as a power generating section, and the like. Among the components mentioned above, the receiving antenna 23 and the detector circuit 24 constitute an electric wave receiving section, and the battery voltage detecting circuit 26 or the power source monitoring circuit 27 constitutes a voltage detecting section.

The microcomputer 10 is a large scale integrated circuit (LSI) and is equipped with a central processing unit (CPU), a register to set various status flags and the like, various counter circuits, an input-output (I/O) circuit to perform an input and an output of a signal, an interface to perform an input and an output of data, and the like, in the inner part of the microcomputer 10. The counter circuits mentioned above include a timing counter to perform timing by counting the signals of the frequency dividing circuit 22 as a timing section.

The timepiece movement 11 is composed of a plurality of systems of movements (such as the step motors and the gear mechanisms), which independently drives the plurality of hands. The plurality of hands includes, for example, a second hand, a minute hand, an hour hand, which rotate at the center of the number plate, a small hand rotating in a small region deviated from the center of the number plate, and the like. The timepiece movement 11 is provided with, for example, a first movement system to drive the second hand, a second movement system to drive the minute hand and the hour hand relatively to each other, and a third movement system to drive the small hand, and the like. The second hand, the minute hand, and the hour hand constitute the time display section. Moreover, the small hand constitutes a display section to perform a status display.

The pulse control circuit 12 outputs a pulse signal to the step motor of each system relatively to the timing operation of the timing counter of the microcomputer 10 on the basis of a command from the microcomputer 10. By the pulse signal, the step motor which has received the input of the pulse signal makes a half turn, and the corresponding second hand, minute hand, hour hand, or small hand rotates by the predetermined angle.

The detecting section 13 is a photo interrupter composed of a light emitting section 13*a* and a light receiving section 13*b*, and has the configuration of arranging the light emitting section 13*a* and the light receiving section 13*b* with the gears rotating relatively to the hands between them. A transmission hole is formed at a predetermined rotation angle position on each gear. The movement of the transmission hole to a part between the light emitting section 13*a* and the light receiving section 13*b* is detected by the operations of the light emission and the light reception of the photo interrupter. Thereby the rotation position of the gear is detected, and the position of the hand moving relatively to the gear is detected on the basis of the rotation position.

The detector circuit 24 is a circuit for demodulating a time code by receiving a standard wave including the time code, and includes a plurality of amplifiers to amplify a received signal, gain control circuits, and the like, in the inner part of the detector circuit 24. The detector circuit 24 consumes a relatively large current at its operation. The detector circuit 24 consumes a current by receiving the input of a battery voltage from the power source section 25 at the time of, for example, executing electric wave receiving processing on the basis of a command from the microcomputer 10. On the other hand, the detector circuit 24 is configured to consume almost no currents from the power source section 25 when the detector circuit 24 does not execute any electric wave receiving processing.

The secondary battery equipped to the power source section 25 has a characteristic in which the secondary battery outputs an almost stabilized output voltage in a range of being charged to a certain degree but the output voltage thereof falls according to the residual quantity of charges when the charged quantity thereof becomes small. The power source section 25 is configured so that the power source voltage supplied from power source section 25 to each section also falls according to the residual quantity of charges of the secondary battery. In this embodiment, the output voltage of the secondary battery is the power source voltage as it is.

The solar panel 28 is provided on, for example, the number plate of the timepiece, and converts an external light into electric power. The electric power generated by the solar panel 28 is transmitted to the secondary battery of the power source section 25 to charge the secondary battery.

The battery voltage detecting circuit 26 is configured to compare the power source voltage with a predetermined threshold voltage (voltage YYY or voltage YYY') and to output a signal indicating the comparison result to the microcomputer 10. The threshold value voltages YYY and YYY', described below in detail, are set to the voltages at which functional operations consuming large currents must be stopped because the residual quantity of charges of the secondary battery has decreased.

The power source monitoring circuit 27 prevents the microcomputer 10 from operating unstably by resetting the microcomputer 10 when the power source voltage becomes lower than the lower limit voltage of the operation of the microcomputer 10. The power source monitoring circuit 27 compares the power source voltage with threshold value voltages ZZZ and ZZZ' in the neighborhood of the lower limit voltage of the operation of the microcomputer 10. The power source monitoring circuit 27 is configured as follows: if the power source voltage is lower than the voltage ZZZ, then the power source monitoring circuit 27 continuously outputs a reset signal to the microcomputer 10; on the other hand, if the power source voltage rises to be higher than the voltage ZZZ', then the power source monitoring circuit 27 cancels the reset signal.

Next, the operation of the electronic timepiece 1 configured as described above will be described.

Figure 2:
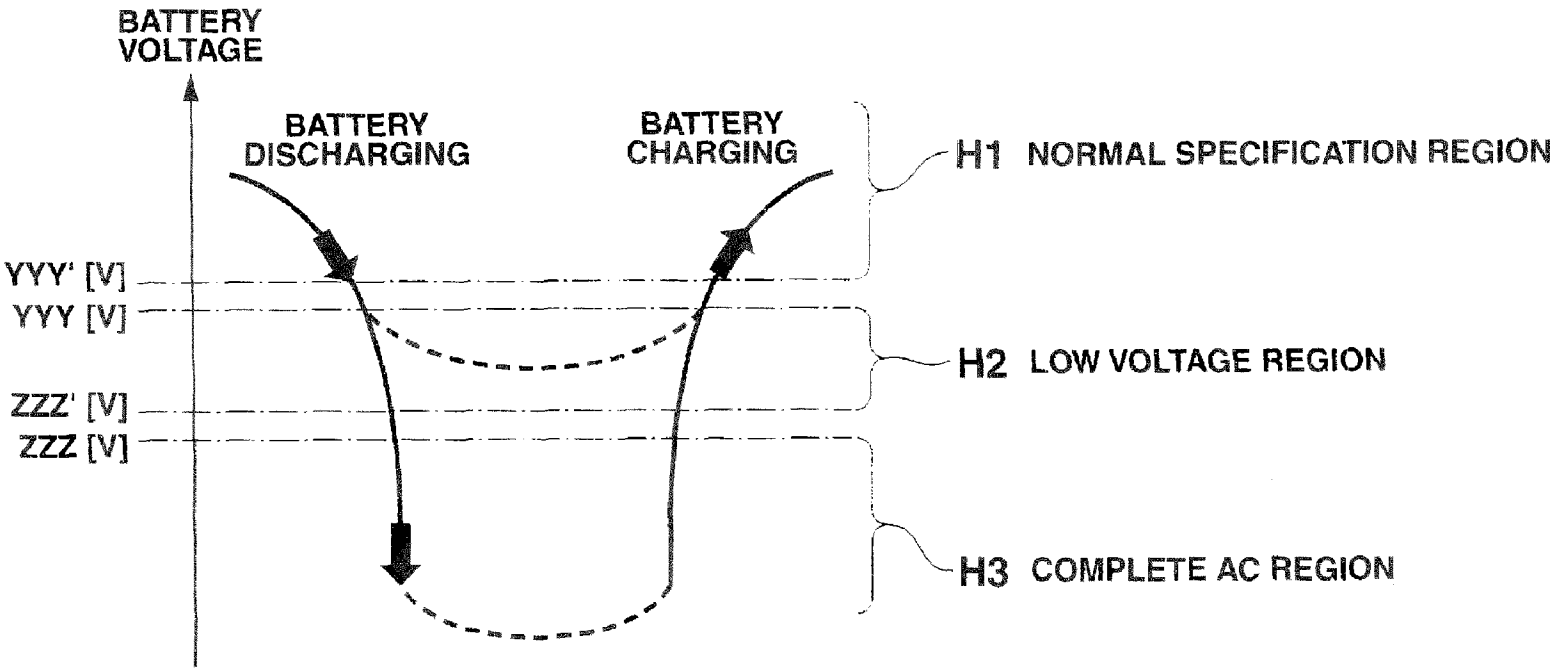
FIG. 2 is a diagram for illustrating state transitions of the electronic timepiece of the first embodiment accompanying the changes of a battery voltage.

FIG. 2 shows a diagram for illustrating state transitions of the electronic timepiece 1 accompanying the changes of the battery voltage.

First, the outline of the control operation when the battery voltage transits a normal specification region H1, a low voltage region H2, and a complete AC region H3 is described.

The normal specification region H1 indicates a range of the battery voltage from the state in which the secondary battery has a sufficient charged quantity to the state in which the battery voltage has reached a charged quantity at which an operation consuming a large current must be avoided; the low voltage region H2 indicates a range of the battery voltage from the state in which the charged quantity of the secondary battery has decreased and the operation consuming a large current must be avoided to the state in which the battery voltage is in the neighborhood of the lower limit voltage of the operation of the microcomputer 10; the complete AC region H3 indicates a range of the battery voltage at which the microcomputer 10 must be reset here.

The voltage range YYY-YYY' of the boundary between the normal specification region H1 and the low voltage region H2 is set to a voltage (for example 2.3 V) at which the operation of the microcomputer 10 can be continued but a processing consuming large electric power must be avoided. Moreover, the voltage range ZZZ-ZZZ' of the boundary between the low voltage region H2 and the complete AC region H3 is set to a voltage (for example 1.3 V) slightly higher than the lower limit voltage of the operation of the microcomputer 10. The reason why the boundary voltage ranges YYY-YYY' and ZZZ-ZZZ' have widths is to add hystereses according to the transition direction of the battery voltage. The voltage range YYY-YYY' is an example of a first level range, and the voltage range ZZZ-ZZZ' is an example of a second level range.

When the battery voltage is in the normal specification region H1, the microcomputer 10 performs the control processing for realizing a normal timepiece function. For example, the microcomputer 10 performs timing processing in the inner part of the electronic timepiece 1 by the timing counter, hand movement processing to rotate the hands in accordance with the value of the timing counter, and the processing to perform time amendment by periodically receiving an electric wave.

When the battery voltage transits from the normal specification region H1 to the low voltage region H2, also the processing of performing the normal hand movement processing until a predetermined time position (for example 12:00:00) before stopping each hand is performed.

After that, if the battery voltage is in the low voltage region H2, the microcomputer 10 makes the timing counter continue the timing processing in the inner part, and on the other hand the microcomputer 10 limits the performance of the hand movement processing and the electric wave receiving processing, both pieces of processing consume a larger current, not to be performed.

When the battery voltage does not fall to the complete AC region H3 but recovers from the low voltage region H2 to the normal specification region H1, the timing data indicating the present time remains in the timing counter, and accordingly the processing of adjusting the hands to the present time (the value of the timing counter) by high speed hand movement is performed without performing any electric wave reception after performing the counting of a predetermined time for checking voltage recovery by a returning counter, described below.

On the other hand, when the battery voltage transits from the low voltage region H2 to the complete AC region H3, the power source monitoring circuit 27 continuously outputs a reset signal to the microcomputer 10 to stop the timing processing in the inner part by the timing counter with the electric wave reception and the hand movement inhibited.

When the battery voltage transits from the complete AC region H3 to the low voltage region H2, the reset signal of the power source monitoring circuit 27 is canceled, and the operation of the microcomputer 10 is reopened. Moreover, also the timing processing of the inner part by the timing counter is reopened. Even if the operation is reopened, when the battery voltage is in the low voltage region H2, the hand movement processing and the electric wave receiving processing, both consuming a large current, are limited not to be performed.

When the battery voltage has once fallen to the complete AC region H3 and then has recovered to the normal specification region H1 through the low voltage region H2 after that, then the timing data of the timing counter is in the state of being out of order. Accordingly, after performing the counting of a predetermined time for checking the recovery of the voltage with the returning counter, described below, the processing of amending the value of the timing counter to the present time by receiving an electric wave and adjusting the hands to the value of the timing counter by the high speed hand movement is performed.

Next, the control processing accompanying the aforesaid changes of the battery voltage will be described in detail with reference to the flow charts of FIGS. 3 and 4.

Figure 3:
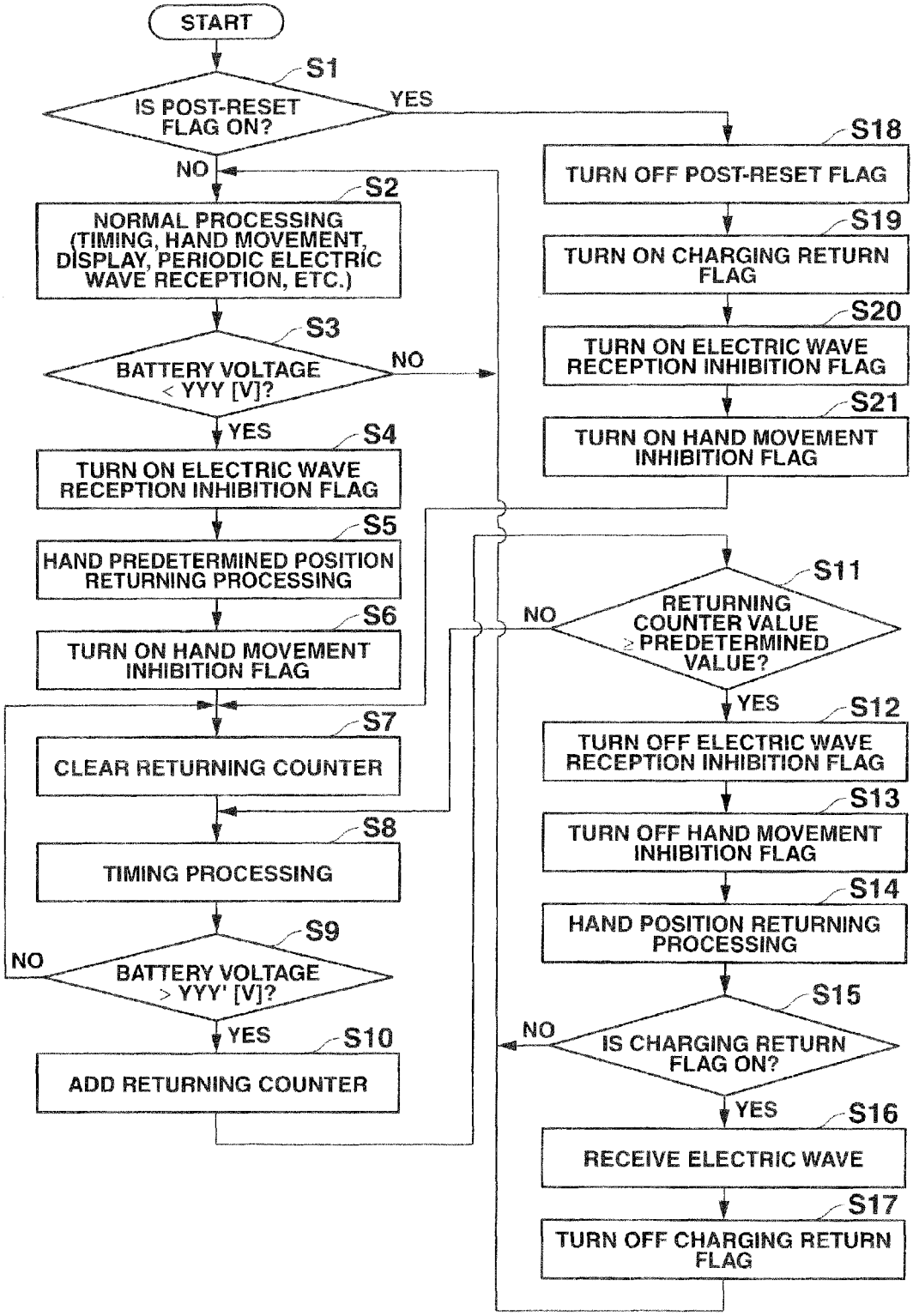
FIG. 3 is a flow chart of control processing executed by a central processing unit (CPU) of a microcomputer.

FIG. 3 is a flow chart of the control processing executed by the CPU of the microcomputer 10.

The control processing of FIG. 3 is started by the CPU of the microcomputer 10 at the time of power activation or at the time of cancelling the reset operation of the microcomputer 10 by the power source monitoring circuit 27, and after that, the control processing is continuously executed. Moreover, the control processing is stopped halfway by the outputting of a reset signal from the power source monitoring circuit 27 to make the microcomputer 10 the reset state thereof.

The control processing regulates the operation of the inner part when the battery voltage changes in the ranges of the normal specification region H1 (see FIG. 2) and the low voltage region H2. In the complete all reset (AC) region H3 of the further lower voltages, the microcomputer 10 is made to the reset state thereof, and consequently the control processing of FIG. 3 does not participate in the microcomputer 10 in that state.

When the battery voltage is in the normal specification region H1 (see FIG. 2), the CPU of the microcomputer 10 repeatedly executes the loop processing at Steps S2 and S3, and thereby the CPU realizes the normal timepiece function.

That is, at Step S2, the CPU performs the updating of the timing counter, hand movement processing to drive the hands in conformity with timing data, the processing of receiving an operation input from a user or displaying a change of operation state with the small hand, periodic electric wave receiving processing of driving the detector circuit 24 periodically to perform electric wave reception and time amendment, and the like. Then, at Step S3, the CPU checks whether the battery voltage becomes lower than the voltage YYY or not on the basis of an input signal from the battery voltage detecting circuit 26. Then, if the battery voltage is in the normal specification region H1, then the CPU repeatedly executes the loop processing at Steps S2 and S3.

When the battery voltage has transited from the normal specification region H1 to the low voltage region H2, the CPU moves the control processing to the side of YES at the judgment processing at Step S3, and thereby performs the processing at Steps S4-S6 for dealing with the voltage drop. That is, the CPU turns on an electric wave reception inhibition flag at Step S4, performs hand predetermined position returning processing at Step S5, and turns on a hand movement inhibition flag at Step S6.

The electric wave reception inhibition flag is a status flag indicating whether electric wave reception is inhibited or not, and the operation of the electric wave reception is inhibited by turning on the electric wave reception inhibition flag here. The hand movement inhibition flag is a status flag for inhibiting the rotation drive of the hands, and, for example, when each hand proceeds to reach a predetermined position (for example, the position at 12:00:00), for inhibiting the rotation drive after that.

Moreover, the hand predetermined position returning processing at Step S5 is the processing for stopping the movements of the hands when the position of each hand reaches the predetermined position (for example the position at 12:00:00) while continuing normal hand movement, and the processing is realized by transmitting, for example, a command of returning the hands to predetermined positions to the pulse control circuit 12. The pulse control circuit 12 is configured to perform pulse outputting relatively to the value of the timing counter after that until the position of each hand reaches the predetermined position on the basis of the command of returning the hands to predetermined positions, but to stop the pulse outputting even if the value of the timing counter advances after the reaching to the predetermined position.

During a period in which the power source voltage is staying in the low voltage region H2 after the power source voltage has transited to the low voltage region H2, the CPU repeatedly executes the loop processing at Steps S7-S9, and thereby the CPU executes the functional operation at the time of a low voltage. That is, the CPU clears the returning counter, described below, at Step S7, and performs the timing processing of updating the timing counter at Step S8. The CPU judges whether the battery voltage exceeds the voltage YYY' or not at Step S9.

That is, when the battery voltage falls to the low voltage region H2, the timing counter of the microcomputer 10 operates, and the electronic timepiece 1 is in the state in which the timing operation is continuously operated in the inner part thereof. Moreover, the electronic timepiece 1 is configured to stop each hand after each hand has been subjected to the hand movement to the predetermined position (12:00:00) when the battery voltage has fallen to the low voltage region H2 by the performance of the hand predetermined position returning processing (Step S5) at the time of the transition from the normal specification region H1 to the low voltage region H2.

The CPU of the microcomputer 10 to execute the processing at Steps S3-S9 constitutes a part of a stop control section.

As described above, when the battery voltage is in the low voltage region H2, the timing processing is continuously performed, and consequently the electronic timepiece 1 becomes the state in which the timing data indicating the present time remains in the inner part of the microcomputer 10 when the battery voltage has recovered to the normal specification region H1. Thereby, it becomes possible to adjust the hands to the present time immediately without performing any electric wave reception.

Moreover, when the battery voltage has fallen to the low voltage region H2, hand movement is stopped, and also the periodic electric wave reception is not performed. Because the operations consuming large currents are thus stopped, it is avoided that the battery voltage rapidly falls.

When the battery voltage has risen from the low voltage region H2 to the normal specification region H1, the battery voltage is judged to exceed the voltage YYY' at Step S9. Consequently, first the CPU moves the control processing to the loop processing at Steps S8-S11, and the CPU performs the processing of checking whether the state in which the battery voltage exceeds the voltage YYY' is continuously kept for a predetermined time or not.

That is, the CPU checks whether the battery voltage is higher than the voltage YYY's or not at Step S9, adds a returning counter at Step S10, and checks whether the counted value of the returning counter exceeds the predetermined value or not at the judgment processing at Step S11. Then, if the counted value of the returning counter does not exceed the predetermined value, the CPU returns the control processing to Step S8 to perform the timing processing, and returns the control processing to Step S9. If the counted value exceeds the predetermined value, the CPU moves the control processing to Step S12 in order to return to the operation in the normal specification region H1.

The returning counter is a counter provided in the inner part of the microcomputer 10, and is provided in order to check whether the battery voltage is in the state of exceeding the voltage YYY' continuously for the predetermined time or not when the battery voltage transits from the low voltage region H2 to the normal specification region H1 here.

On the other hand, when the battery voltage has again fallen to the low voltage region H2 during the count processing of the returning counter, the CPU moves the control processing to Step S7 at the judgment processing of the battery voltage at Step S9, and thereby the CPU again returns the control processing to the loop processing (Steps S7-S9) regulating the control operation of the low voltage region H2. The CPU clears the returning counter at Step S7 in the loop processing.

When the battery voltage has transited from the low voltage region H2 to the normal specification region H1 and the predetermined time has elapsed in that state, the CPU branches the control processing to the side of YES at the judgment processing of the returning counter value at Step S11, and then the CPU first performs the processing necessary at the time of voltage recovery at Steps S12-S17. That is, the CPU turns off the electric wave reception inhibition flag at Step S12, turns off the hand movement inhibition flag at Step S13, and performs the hand position returning processing at Step S14.

The turning-off of the electric wave reception inhibition flag and the hand movement inhibition flag here is for the recovery of the timepiece function at the normal time by cancelling the inhibition of the electric wave reception operation and the hand movement operation, which have been inhibited at the time of the transition to the low voltage region H2.

Moreover, the hand position returning processing at Step S14 is the processing for performing the rotation driving of the hands at a high speed to adjust the position of each hand to the timing data of the timing counter, and the hand position returning processing is realized by, for example, transmitting a command of hand position returning to the pulse control circuit 12. The pulse control circuit 12 performs pulse outputting of a higher speed than that at the time of normal hand movement to each step motor on the basis of the command of hand position returning, and drives the respective hands to the positions indicated by the counted value of the timing counter. Thereby, the respective hands are advanced to the positions corresponding to the counted value of the timing counter. Because each hand is stopped at the predetermined position (for example 12:00:00), at which each hand has been stopped when the battery voltage has moved to the low voltage region H2, the microcomputer 10 and the pulse control circuit 12 can perform the processing of the hand movement in the state of recognizing the position of each hand.

After the CPU has performed the hand position returning processing at Step S14, the CPU checks whether the charging return flag is on or not at the subsequent Step S15. If the charging return flag is off, then the CPU makes the control processing jump to Step S2 as it is. On the other hand, if the charging return flag is on, then the CPU performs electric wave reception at Step S16, and turns off the charging return flag at Step S17. After that, the CPU makes the control processing jump to Step S2.

The charging return flag is a flag set for identifying whether the battery voltage has once fallen to the complete AC region H3 and then has recovered to the normal specification region H1, or whether the battery voltage has not fallen to the complete AC region H3 but has recovered from the low voltage region H2 to the normal specification region H1. If the battery voltage has once fallen to the complete AC region H3, then the CPU processes the charging return flag to be on; if the battery voltage has not fallen to the complete AC region H3, then the CPU processes the charging return flag to be off.

That is, if the battery voltage has fallen to the complete AC region H3 before and timing data has been reset, then the CPU performs the processing of receiving an electric wave to amend the timing data to the present time by the processing at Steps S15-S17. On the other hand, if the battery voltage has not fallen to the complete AC region H3 before and the timing data remains, the CPU omits the electric wave reception.

Then, after the jumping to Step S2, the CPU returns the control processing to the loop processing (Steps S2 and S3) to realize the normal timepiece function.

Next, a description will be given to the case where the battery voltage falls to the complete AC region H3 (see FIG. 2) and the case where the battery voltage recovers from the complete AC region H3 to the low voltage region H2. The control in such voltage regions is realized by the reset processing of the power source monitoring circuit 27.

Figure 4:
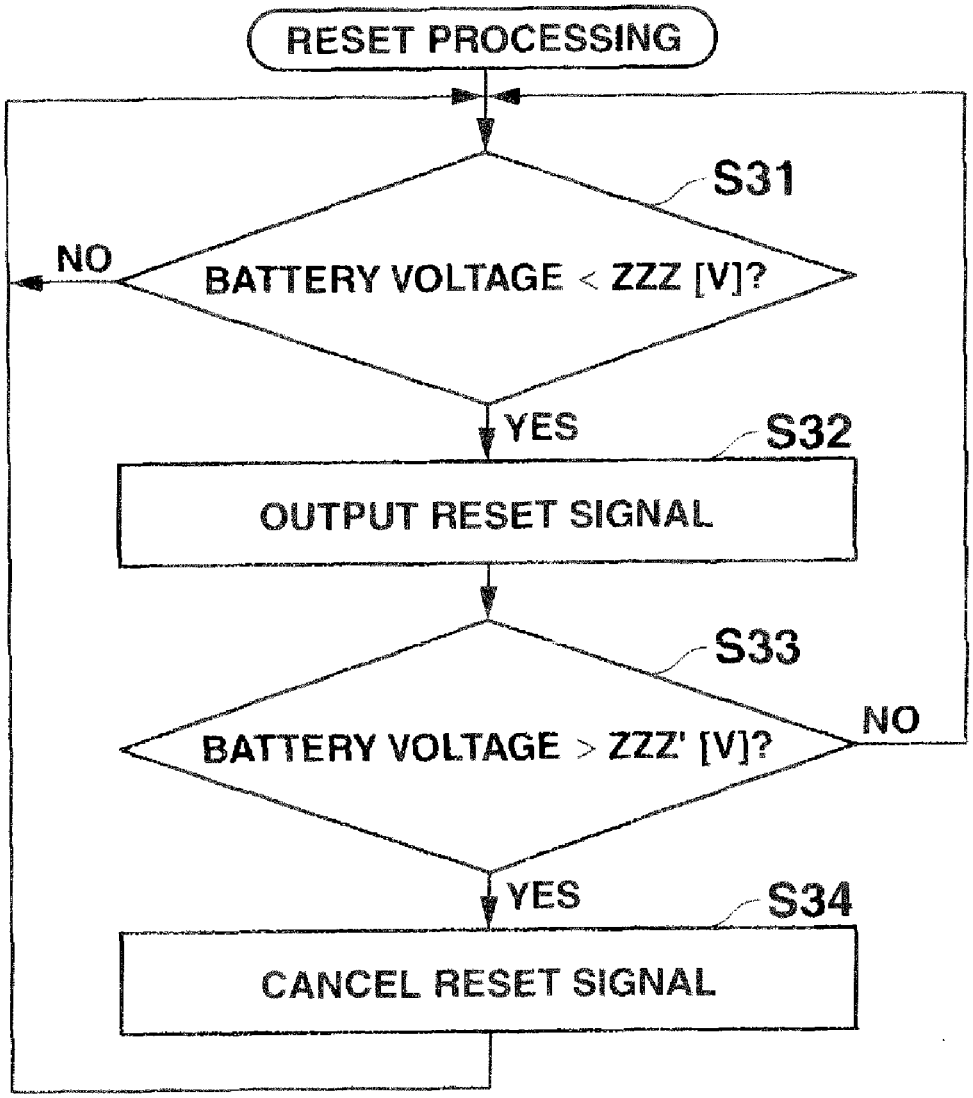
FIG. 4 is a flow chart showing an operation procedure of a power source monitoring circuit.

FIG. 4 shows a flow chart showing the operation procedure of the power source monitoring circuit 27.

As shown in FIG. 4, the power source monitoring circuit 27 detects whether the battery voltage has changed to be lower than the voltage ZZZ (Step S31), or whether the battery voltage has changed to be higher than the voltage ZZZ' (Step S33). When the battery voltage has changed to be lower than the voltage ZZZ, the power source monitoring circuit 27 continuously outputs a reset signal to the microcomputer 10 until the battery voltage changes to be higher than the voltage ZZZ' afterward (Step S32). Then, when the battery voltage has changed to be higher than the voltage ZZZ', the power source monitoring circuit 27 cancels the reset signal (Step S34).

When the battery voltage falls to the complete AC region H3 and the power source monitoring circuit 27 inputs the reset signal to the microcomputer 10, then the control processing of FIG. 3 is interrupted, and all of the values of the register and the various counters of the microcomputer 10 are cleared. The microcomputer 10 initializes various status flags set in the register to the values of off-flag on the basis of the reset signal but initializes the post-reset flag indicating whether the microcomputer 10 is in the post-reset state or not to the value of on-flag on the basis of the reset signal here.

The reset control of the power source monitoring circuit 27 constitutes a part of the stop control section.

Next, when the battery voltage rises from the complete AC region H3 to the low voltage region H2 and the reset signal of the power source monitoring circuit 27 is cancelled, the CPU of the microcomputer 10 reopens the control processing of FIG. 3 from Step S1 in the initialized state.

The post-reset flag is on immediately after the reset here, and accordingly the CPU branches the control processing to the side of YES at the judgment processing at Step S1. The CPU performs the processing at the time of reset cancel at Steps S18-S21 first.

That is, the CPU sequentially changes the post-reset flag, the charging return flag, the electric wave reception inhibition flag, and the hand movement inhibition flag to be off, on, on, and on, respectively, at Steps S18-S21, respectively. That is, because the post-reset flag is a flag for judging whether the microcomputer 10 is after reset or not at Step S1, the CPU returns the state of the post-reset flag to be off after the judgment at Step S1. Moreover, because the charging return flag is a flag for identifying whether the battery voltage has once fallen to the complete AC region H3 or not, the CPU turns on the charging return flag. Because the electric wave reception and the hand movement are inhibited in the low voltage region H2, in which the present battery voltage is situated, the CPU turns on the electric wave reception inhibition flag and the hand movement inhibition flag.

Then, when the CPU has completed the aforesaid reset cancelling processing, the CPU makes the control processing jumps to Step S7 and moves the control processing to the above-mentioned loop processing of the low voltage region H2 (Steps S7 and S8).

The CPU of the microcomputer 10 to execute the control of the reset cancel of the power source monitoring circuit 27 and the processing at Steps S18-S20 constitutes a start control section.

By the control processing by the CPU of the microcomputer 10 and the reset processing by the power source monitoring circuit 27 described above, the operation states of the electronic timepiece 1 dealing with each of the normal specification region H1, the low voltage region H2, and the complete AC region H3 are realized when the battery voltage changes over the regions H1-H3 as shown in FIG. 2.

As described above, according to the electronic timepiece 1 of the first embodiment, when the charged quantity of the secondary battery has fallen and the battery voltage is falling, the processing consuming a large current, such as hand movement and electric wave reception, is first stopped at the stage at which the battery voltage becomes lower than the voltage YYY, which is relatively high, and consequently it can be prevented that the battery voltage rapidly falls owing to the processing consuming a large current.

Moreover, because the timing operation is continued by the timing counter in the inner part of the electronic timepiece 1 in the period in which the battery voltage is situated in the low voltage region H2, the battery voltage does not become lower to the complete AC region H3. Then, when charging is performed and the battery voltage recovers from the low voltage region H2 to the normal specification region H1, each hand can be rapidly adjusted to the present time without performing any electric wave reception.

Second Embodiment

Figure 5:
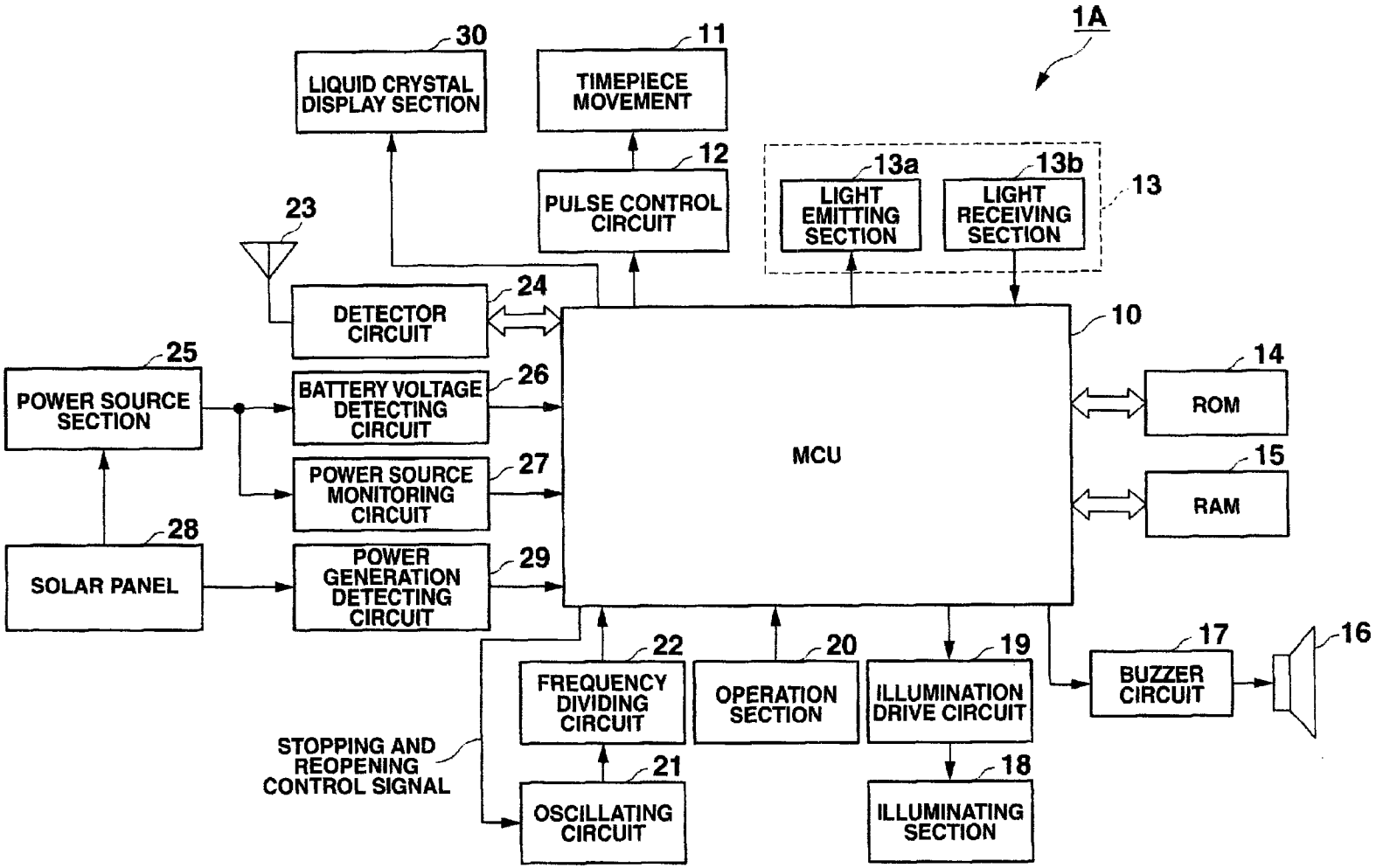
FIG. 5 is a block diagram showing the internal configuration of an electronic timepiece of a second embodiment of the present invention.

FIG. 5 is a block diagram showing the internal configuration of an electronic timepiece 1A of a second embodiment of the present invention.

The electronic timepiece 1A of the second embodiment is one produced by changing a part of the hardware configuration of the electronic timepiece 1 of the first embodiment and a part of the operation control thereof when the battery voltage falls. The descriptions of the similar configurations to those of the first embodiment are omitted.

In the electronic timepiece 1A of this embodiment, a power generation detecting circuit 29 as a power generation detecting section is added to the hardware configuration of the first embodiment as shown in FIG. 5. The power generation detecting circuit 29 detects the performance of power generation of electric power equal to or more than a predetermined quantity by the solar panel 28, and the detected output of the power generation detecting circuit 29 is input into an interrupt terminal of the microcomputer 10. Then, when the microcomputer 10 is in its sleep mode, the microcomputer 10 is configured to cancel the sleep mode thereof by the output of the power generation detecting circuit 29. Furthermore, as the display section to perform a warning display, described below, a liquid crystal display section 30 is added.

Moreover, the electronic timepiece 1A of this embodiment is configured so that the microcomputer 10 outputs the control signals of operation stopping and operation opening to the oscillating circuit 21 to enable the switching between stopping and reopening the oscillation operation of the oscillating circuit 21.

The microcomputer 10 is configured to move among a plurality of states of a normal operation mode, the sleep mode to stop the operation of the CPU and the access to the ROM 14 and the RAM 15, and a reset state into which the microcomputer 10 is moved by the processing of the power source monitoring circuit 27 when the power source voltage becomes the lower limit voltage of operation. When the microcomputer 10 moves to the sleep mode, the microcomputer 10 outputs a control signal to stop the operation of the oscillating circuit 21 to the oscillating circuit 21 to also stop the operation of the oscillating circuit 21. Consequently, the electronic timepiece 1A is configured so that the oscillating circuit 21 becomes a stopping state in a period of the sleep mode and the period of the reset state to limit the consumption current of the whole apparatus to a very small value (for example, several tens of nanoamperes).

Next, the operation of the electronic timepiece 1A having the configuration described above will be described.

Figure 6:
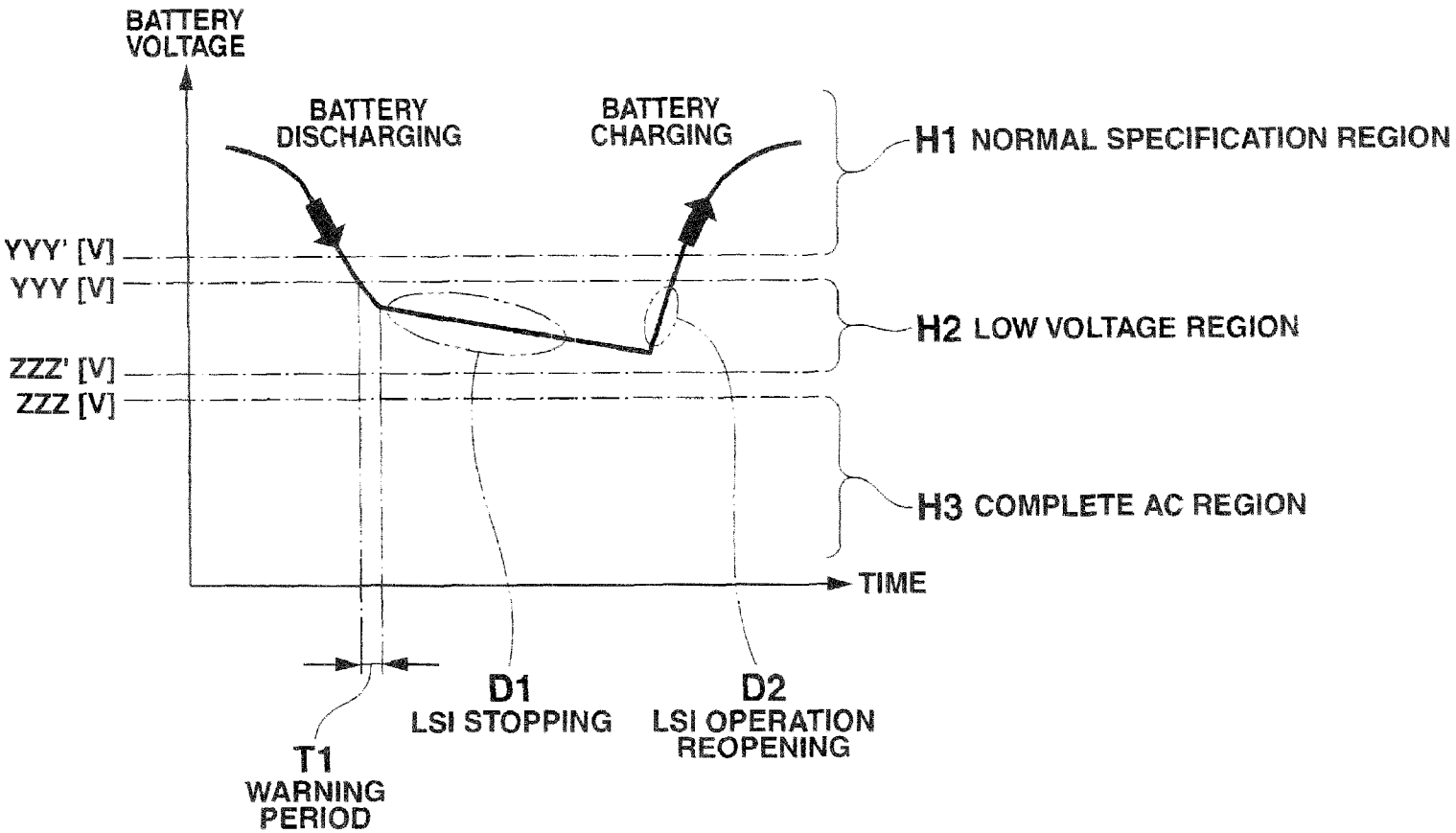
FIG. 6 is a diagram for illustrating state transitions of the electronic timepiece of the second embodiment accompanying the changes of a battery voltage.

FIG. 6 is a diagram for illustrating the state transitions of the electronic timepiece 1A accompanying the changes of the battery voltage.

First, the outline of the control operation when the battery voltage transits the normal specification region H1, the low voltage region H2, and the complete AC region H3 will be described.

When the battery voltage is in the normal specification region H1, the microcomputer 10 performs the control processing to realize the normal timepiece function.

When the battery voltage falls and transits from the normal specification region H1 to the low voltage region H2, warning output processing for urging a user to charge the secondary battery in a predetermined warning period T1 (for example, one week) is performed by the control of the microcomputer 10. The warning output processing will be described later. Moreover, the periodic electric wave reception is inhibited in the warning period T1. On the other hand, the timing counter is made to the state of continuing timing operation.

Consequently, when charging has been performed in the warning period T1 and the battery voltage has recovered to the normal specification region H1, it becomes possible to adjust the displayed time to the present time without performing any electric wave reception because the timing operation of the inner part remains continuing.

On the other hand, if the warning period T1 has elapsed without performing any charging, the microcomputer 10 moves to the sleep mode (LSI stopping state D1) by the control of the CPU. In the sleep mode, the operation of the CPU of the microcomputer 10 is stopped, and the access to the memory is also stopped. Furthermore, because the oscillation operation of the oscillating circuit 21 is also stopped, the consumption current of the electronic timepiece 1A is limited to be very small.

Consequently, if the microcomputer 10 moves to the LSI stopping state D1, then the decreasing speed of the battery voltage becomes very slow afterward even if the state of not performing charging continues. For example, about one year of a grace period can be obtained until the battery voltage falls in the complete AC region H3 or the secondary battery is fully discharged. Accordingly, by performing charging in the period in which the microcomputer 10 is in the LSI stopping state D1, it becomes possible to rapidly recover the battery voltage to the normal specification region H1.

When the microcomputer 10 moves to the LSI stopping state D1, the timing operation of the inner part once stops and the timed time in the inner part becomes out of order, but the displayed time can be adjusted to the present time relatively rapidly by performing the electric wave reception when the battery voltage recovers to the normal specification region H1.

If the power generation equal to or more than a predetermined quantity is performed in the state in which the microcomputer 10 is in the LSI stopping state D1, the power generation detecting circuit 29 detects the power generation to cancel the sleep mode of the microcomputer 10, and the microcomputer 10 moves to an LSI operation reopening state D2. When the microcomputer 10 moves to the LSI operation reopening state D2, the operation of the CPU of the microcomputer 10 is reopened, and the oscillation operation of the oscillating circuit 21 and the timing operation of the timing counter in the inner part are also reopened.

Incidentally, even if the microcomputer 10 moves from the LSI stopping state D1 to the LSI operation reopening state D2 owing to power generation equal to or more than the predetermined quantity, the electronic timepiece 1A is configured to make the microcomputer 10 move to the LSI stopping state D1 again if power generation is again stopped and the state continues for a little while (for example, for 1-10 minutes).

If the battery voltage has transited from the low voltage region H2 to the normal specification region H1 after the microcomputer 10 has moved to the LSI operation reopening state D2, the timing data indicating the present time remains in the timing counter if the transition has not passed through the LSI stopping state D1, and accordingly the microcomputer 10 performs the processing to adjust the hands to the present time (the value of the timing counter) by high speed hand movement without performing any electric wave reception. On the other hand, if the transition has passed through the LSI stopping state D1, no timing data indicating the present time remains in the timing counter, and accordingly the microcomputer 10 performs electric wave reception and performs the processing of adjusting the hands to the present time (the value of the timing counter) by the high speed hand movement.

If the battery voltage falls to be lower than the voltage range ZZZ-ZZZ' and falls into the complete AC region H3, or if the battery value rises by charging afterward to be higher than the voltage range ZZZ-ZZZ', then the power source monitoring circuit 27 controls the microcomputer 10 to the reset state thereof or to cancel the rest state almost similarly to the first embodiment.

However, in the second embodiment, because the oscillating circuit 21 is subjected to the stopping control at the state of the moving of microcomputer 10 to the LSI stopping state D1, in which the battery voltage is in the low voltage region H2, the oscillating circuit 21 is made to the stopped state and the consumption current is made to be smaller by the consumption quantity of the oscillating circuit 21 in the period in which the battery voltage falls to the complete AC region H3 and the microcomputer 10 is made to the reset state.

Next, a detailed description will be given to the control processing accompanying the changes of the battery voltage mentioned above with reference to the flow chart of FIGS. 7-9.

Figure 7:
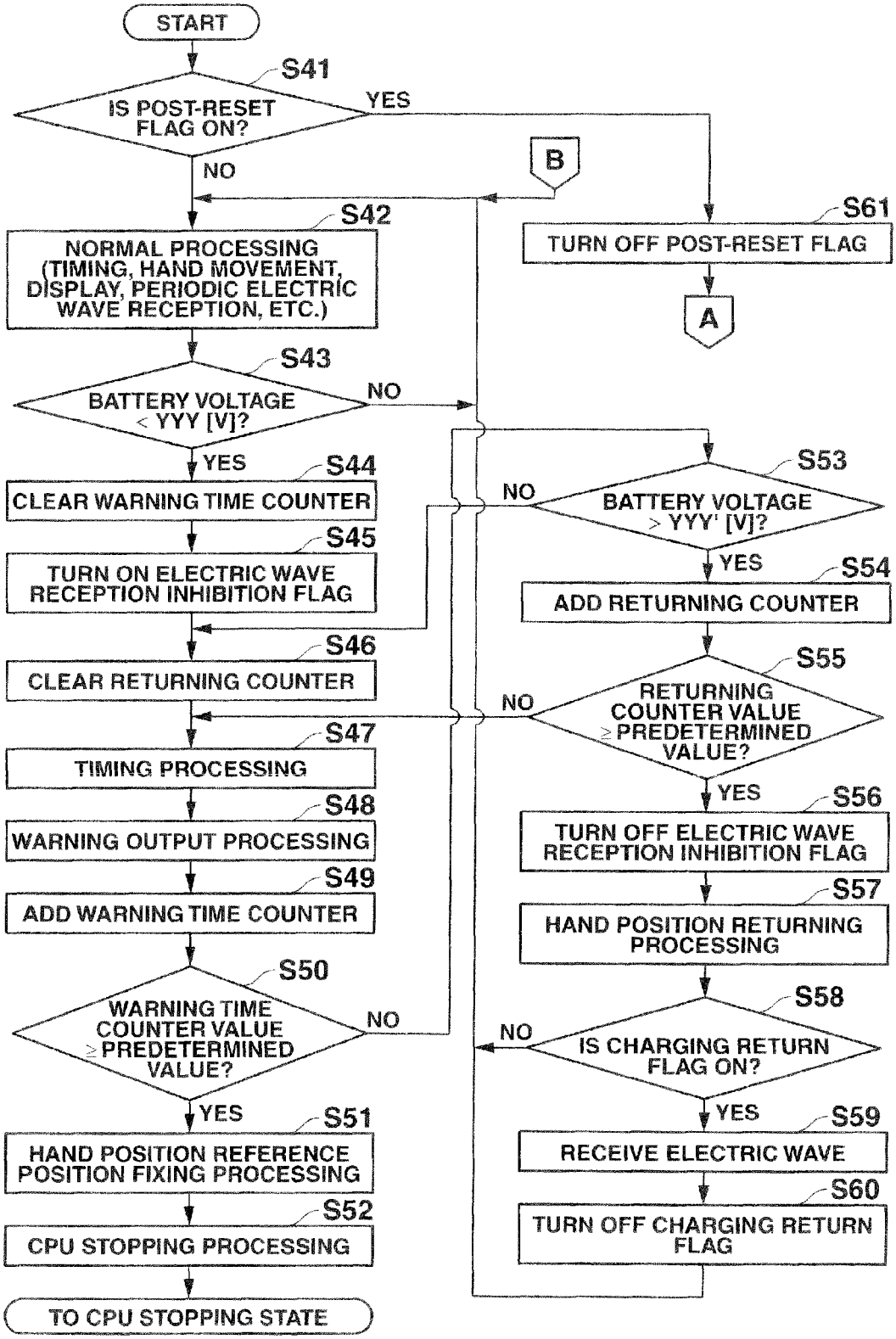
FIG. 7 is a flow chart of control processing executed by a CPU of a microcomputer.
Figure 8:
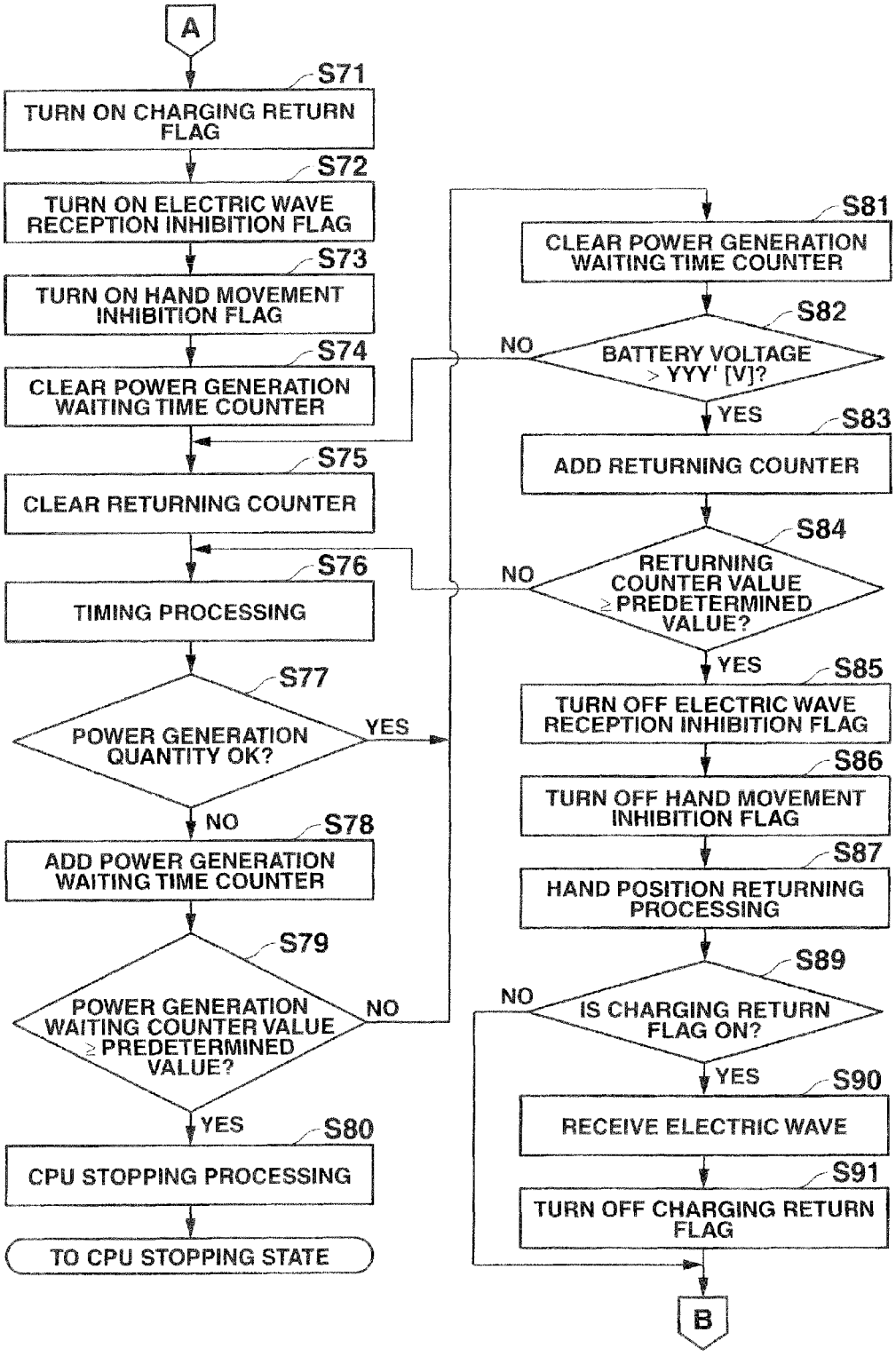
FIG. 8 is another flow chart of the control processing executed by the CPU of the microcomputer.
Figure 9:
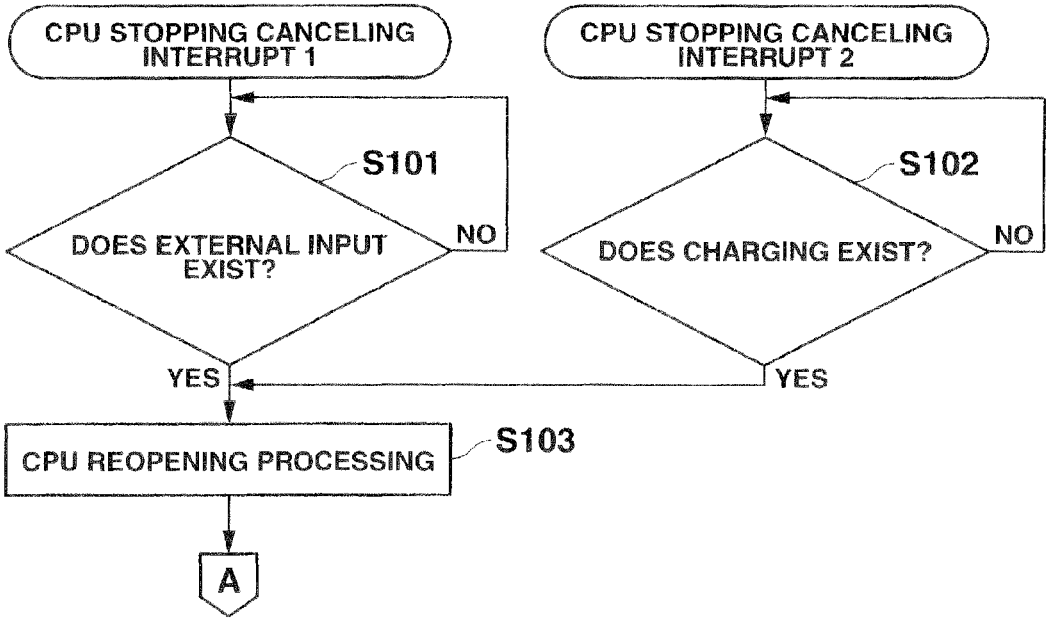
FIG. 9 is a flow chart of interrupt processing for cancelling a stopping state of the CPU at the time of a sleep mode of the microcomputer.

FIGS. 7 and 8 is a flow chart showing control processing executed by the CPU of the microcomputer 10, and FIG. 9 is a flow chart of the interrupt processing for cancelling the stopping state of the CPU at the time of the sleep mode of the microcomputer 10.

The control processing of FIGS. 7 and 8 is started at the time of power activation or the reset cancel of the microcomputer 10 by the power source monitoring circuit 27, and is continuously executed by the CPU of the microcomputer 10 afterward. The control processing regulates the operation of the inner part when the battery voltage is in the normal specification region H1 and the low voltage region H2, and the microcomputer 10 is made to be the reset state in the complete AC (all reset) region H3, in which the battery voltage becomes further lower. Consequently, the control processing in FIGS. 7 and 8 does not participate in the reset state.

If the battery voltage is in the normal specification region H1, then the CPU of the microcomputer 10 repeatedly executes the loop processing at Steps S42 and S43, and thereby realizes the normal timepiece function. That is, at Step S42, the CPU performs the update of the timing counter, the hand movement processing to drive the hands in conformity with the timing data, the processing of receiving a user's operation input and displaying a change of the operation state with the small hand, the periodic electric wave receiving processing to drive the detector circuit 24 periodically to perform the electric wave reception and the time amendment. Then, at Step S43, the CPU checks whether the battery voltage is lower than the voltage YYY on the basis of the input signal from the battery voltage detecting circuit 26.

When the battery voltage transits from the normal specification region H1 to the low voltage region H2, the CPU moves the control processing to the side of YES by the judgment processing at Step S43, and thereby the CPU performs the processing for dealing with the voltage drop at Steps S44-S46. That is, at Step S44, the CPU clears the warning time counter, and at Step S45, turns on the electric wave reception inhibition flag.

The warning time counter is a counter provided within the microcomputer 10 for counting the warning period T1 of FIG. 6 here. The turning-on of the electric wave reception inhibition flag aims to indicate also the inhibition of the periodic electric wave reception and the electric wave reception by an operation of a user in the low voltage region H2.

In a period to the time when the warning period T1 has elapsed after the battery voltage has transited to the low voltage region H2, the CPU executes the operation in the warning period T1 by repeatedly executing the loop processing at Steps S46-S50 and S53. That is, the CPU clears the returning counter at Step S46 and performs timing processing to update the timing counter at Step S47. Furthermore, the cup performs the warning output processing at Step S48, adds the warning time counter at Step S49, and judges whether the value of the warning time counter exceeds a predetermined value indicating the warning period T1 or not at Step S50. Then, if the value of the warning time counter does not exceed the predetermined value, then the CPU judges whether the battery voltage exceeds the voltage YYY' or not at Step S53. If the battery voltage is in the low voltage region H2, then the CPU branches the control processing to the side of NO, and consequently the CPU repeats the loop processing at these Steps S46-S50 and S53.

The warning output processing at Step S48 in the loop processing is an operation to intermittently perform the hand movement of, for example, the second hand by outputting n (n is an integer of two or more) pulses for n seconds to the step motor to rotate the second hand. Viewing the intermittent hand movement of the second hand, a user notices the poor charge state of the electronic timepiece 1A and can greatly recover the charged quantity of the secondary battery by performing power generation thereof by, for example, using the electronic timepiece 1A on the next day.

Incidentally, the purpose of the warning output processing is to urge charging by having a user notice the poor charge state, and accordingly various variations can be applied as the warning output processing. For example, because the warning period is one week, the processing of performing the intermittent hand movement for 2-6 days and afterward stopping the hands at a predetermined time position (for example 12:00:00) may be adopted.

Moreover, the intermittent hand movement may be performed as the warning output processing by changing the intermittent interval of the hand movement to be longer every predetermined time (for example, every day).

Moreover, as the warning output processing, the hands may be stopped at a predetermined time position after the performance of irregular hand movement such as reverse rotation of each hand, repeated advancing and returning, and intermittent hand movement including the minute hand and the hour hand.

Moreover, as the warning output processing, each hand may be simply stopped at a predetermined time position after performing the normal hand movement of each hand. Moreover, if nonvolatile memory or the like is provided, each hand may be immediately stopped when the battery voltage enters the warning period T1, and the stopping position of each hand may be stored in the nonvolatile memory. By storing the stopping position of each hand into the nonvolatile memory, the position of each hand is not lost even if the microcomputer 10 is once reset.

Moreover, as the warning output processing, a warning display may be performed by the small hand rotating in a small region on the number plate. For example, a position indicating a poor charge state is provided in the small region on the number plate beforehand, and the small hand is rotated to the position of the poor charge state as the warning output processing. Moreover, the warning out processing may be configured to indicate the residual days of the warning period T1 or the like with the small hand or the second hand.

As the other warning output processing, a warning display may be performed by a display section capable of a dot display or a segment display, such as the liquid crystal display section 30. By the display of the display section, the display of the poor charge state may be performed (for example, a lighting display of a charge mark), or the residual days of the warning period T1 or the like may be displayed.

By the warning output processing described above, it becomes possible to urge a user to charge the electronic timepiece 1A, and the charged quantity of the secondary battery can be greatly recovered by user's charging after noticing the warning output. The CPU of the microcomputer 10 to execute the aforesaid warning output processing or the pulse control circuit 12 constitutes a hand movement control section or a display control section to perform a warning display.

If charging is performed in the warning period T1 mentioned above and the battery voltage exceeds the voltage YYY', the CPU branches the control processing to the side of YES at the judgment processing of the battery voltage at Step S53, and thereby first performs the counting of a predetermined time by the returning counter for checking the recovery of the voltage (Steps S54 and S55) with the warning operation and the counting of the warning period T1 performed by the loop processing at Steps S53-S55 and S47-S50. The returning counter is the same one as that of the first embodiment.

Then, when the returning counter value becomes the predetermined value or more with the battery voltage exceeding the voltage YYY', the CPU branches the control processing to the side of YES at the judgment processing at Step S55, and performs the processing necessary at the time of the voltage recovery at Steps S56-S60. That is, the CPU turns off the electric wave reception inhibition flag at Step S56, and performs the hand position returning processing at Step S57. Successively, the CPU checks whether the charging return flag is on or not at Step S58. If the charging return flag is off, the CPU returns the control processing to Step S42 as it is. On the other hand, if the charging return flag is on, then the CPU performs electric wave reception at Step S59 and turns off the charging return flag at Step S60. After that, the CPU returns the control processing to Step S42. After the movement to Step S42, the control processing is returned to the loop processing (Steps S42 and S43) to realize the normal timepiece function. The processing at these Steps S56-S60 is similar to that at Steps S12 and S14-S17 of the first embodiment.

On the other hand, if the warning period T1 has elapsed while the battery voltage is in the low voltage region H2, then the CPU branches the control processing to the side of YES in the judgment processing of the warning time counter at Step S50, and performs preparation processing for moving the microcomputer 10 to the sleep mode at Steps S51 and S52. That is, at Step S51, the CPU performs the processing of fixing the hand positions to a reference position (for example, 12:00: 00), and at Step S52, the CPU performs the preparation processing such as stopping the oscillating circuit 21 and enabling the reception of an interrupt signal of the cancel of the sleep.

The hand position reference position fixing processing at Step S51 is realized by, for example, transmitting a command of returning the hands to predetermined positions to the pulse control circuit 12. The pulse control circuit 12 is configured to stop the pulse outputting when the position of each hand reaches the predetermined position afterward on the basis of the command of returning the hands to the predetermined positions. Incidentally, if the hand positions are stopped at the predetermined positions by the warning output processing at Step S48, then the hand position reference position fixing processing at Step S51 is omitted.

Then, after performing the preparation processing for moving to such a sleep mode, the microcomputer 10 moves to the sleep mode by the control of the CPU. In the sleep mode, various operations of the microcomputer 10 such as a CPU operation, memory access, the timing operation of the timing counter, and operation timepieceing are stopped besides enablement of the reception of a returning interrupt signal.

The CPU to execute the processing at Steps S43-S52 constitutes the stop control section.

When the microcomputer 10 moved to the sleep mode and the CPU stops, the microcomputer 10 is configured to receive two types of cancel interrupt of stop cancelling as shown in the flow chart of FIG. 9. That is, the CPU receives first CPU stopping canceling interrupt processing to check a signal input from the outside through the operation section 20 (Step S101) to perform the stopping cancel of the CPU (Step S103), and second CPU stopping canceling interrupt processing to check that the power generation detecting circuit 29 has detected power generation equal to or more than a predetermined quantity (Step S102) to perform the stopping cancel of the CPU (Step S103).

At CPU reopening processing at Step S103, for example, the microcomputer 10 outputs a control signal of operation reopening to the oscillating circuit 21 to make the oscillating circuit 21 operate, and further reopens the supply of the operation timepieces of the microcomputer 10 to return the control to the CPU. When the control is returned to CPU by the interrupt processing, the CPU reopens the control processing from Step S71 in the flow chart of FIG. 8.

When power generation is performed and the microcomputer 10 becomes the LSI operation reopening state D2 of FIG. 6, the CPU of the microcomputer 10 first performs the preparation processing of operation reopening at Steps S71-S74. That is, the CPU turns on the charging return flag to indicate that the timing counter has once stopped at Step S71, turns on the electric wave reception inhibition flag at Step S72, turns on the hand movement inhibition flag at Step S73, and clears the power generation waiting time counter at Step S74.

Next, when the battery voltage rises in the low voltage region H2 with power generation performed, the CPU repeatedly executes the loop processing at Steps S75-S77 and S81-S82. That is, the CPU clears the returning counter at Step S75, makes the timing counter perform timing processing at Step S76, and checks whether power generation is performed equally to or more than the predetermined quantity or not at Step S77. Next, the CPU clears the power generation waiting time counter at Step S81, and checks whether the battery voltage exceeds the voltage YYY' or not at Step S82. By this loop processing, the CPU executes the timing operation, performing the check of the continuation of power generation and the check of the battery voltage.

The power generation waiting time counter is the counter for performing counting a predetermined time at the preceding stage of moving the microcomputer 10 to the sleep mode again owing to another fall of the power generation quantity after the microcomputer 10 has become the LSI operation reopening state D2 by the performance of power generation here. That is, if the microcomputer 10 is moved to the sleep mode immediately after one fall of the power generation quantity, then the operation of the microcomputer 10 could be unstable. Accordingly, the control of moving the microcomputer 10 to the sleep mode again when the power generation quantity has fallen and a certain time has elapsed is performed, and the aforesaid power generation waiting time counter is used for the counting of time in that case.

The aforesaid CPU stopping canceling interrupt processing at Steps S101-S103 and the CPU of the microcomputer 10 to execute the loop processing including the timing processing at Step S76 constitute a first start control section.

Next, when charging advances in the LSI operation reopening state D2 (see FIG. 6) and the battery voltage exceeds the voltage YYY', the CPU branches the control processing to the side of YES in the judgment processing of the battery voltage at Step S82, and thereby the CPU first performs timing by the returning counter (Steps S83 and S84) necessary for returning the operation of the electronic timepiece 1 to the normal operation while performing the timing operation by the timing counter by the loop processing at Steps S82-S84 and S76-S77.

Then, when the value of the returning counter becomes the predetermined value or more with the battery voltage exceeding the voltage YYY', then the CPU branches the control processing to the side of YES at the judgment processing at Step S84 and performs the processing necessary at the voltage recovery at Steps S85-S91. That is, the CPU turns off the electric wave reception inhibition flag at Step S85, turns off the hand movement inhibition flag at Step S86, and performs the hand position returning processing at Step S87.

Successively, the CPU checks whether the charging return flag is on or not at Step S89. If the charging return flag is off, then the CPU returns the control processing to Step S42 as it is. On the other hand, if the charging return flag is on, then the CPU performs electric wave reception at Step S90, and the CPU returns the control processing to Step S42 after turning off the charging return flag at Step S91. After the CPU moves the control processing to Step S42, the CPU reopens the loop processing (Steps S42 and S43) to realize the normal timepiece function. The processing at these Steps S85-S91 is similar to that at Steps S12-S17 of the first embodiment.

The CPU of the microcomputer 10 to execute the processing at Steps S82-S91 mentioned above constitutes a second start control section.

On the other hand, if charging stops in the LSI operation reopening state D2 (see FIG. 6), the CPU branches the control processing to the side of NO at the judgment processing at Step S77, and performs the addition processing (Step S78) of the power generation waiting time counter and the processing of judging whether or not the value of the power generation waiting time counter becomes a predetermined value or more (Step S79). Then, if the value of the power generation waiting time counter has not reached the predetermined value, the CPU moves the control processing to Step S81 similarly to the case where the power generation is judged to be OK at Step S77. But if the value of the power generation waiting time counter has become the predetermined value or more, then the CPU judges that power generation has not been performed for a predetermined time continuously, and the CPU moves the control processing to Step S80 in order to move the microcomputer 10 to the sleep mode.

After the movement to Step S80, the CPU performs CPU stopping processing, such as stopping the oscillating circuit 21 and allowing the reception of an interrupt signal of sleeping cancelling, and the microcomputer 10 moves to the sleep mode. The conditions of canceling the sleep mode are the same as those in the case of the movement to the sleep mode at the CPU stopping processing at Step S52 described above.

On the other hand, if the battery voltage has fallen to the complete AC region H3 (see FIG. 6) with the microcomputer 10 having moved into the sleep mode, a reset signal is output to the microcomputer 10 by the control of the power source monitoring circuit 27, and the microcomputer 10 is made to the reset state.

Furthermore, when the battery voltage has risen to transit from the complete AC region H3 to the low voltage region H2, the reset state of the microcomputer 10 is cancelled by the control of the power source monitoring circuit 27. When the reset state is cancelled, the CPU of the microcomputer 10 reopens the control processing of FIG. 7 in the initialized state. Because the post-reset flag is on immediately after the reset, the CPU branches the control processing to the side of YES at the judgment processing at Step S41 and first turns off the post-reset flag at Step S61. Furthermore, the CPU makes the control processing jump to Step S71 of FIG. 8 to perform the processing at the time of reset canceling at Steps S71-S75, and moves the control processing to those of in the LSI stopping state D1 and the LSI operation reopening state D2 mentioned above on and after Step S76.

By the control processing described above, the control operation in each state shown in FIG. 6 is realized.

According to the electronic timepiece 1A of the second embodiment, when the battery voltage has fallen to transit from the normal specification region H1 to the low voltage region H2, the electronic timepiece 1A performs the display or operation of urging a user to perform charging in the predetermined warning period T1, and the user notices the poor charge state at the incipient stage of the decrease of the charged quantity. Then the user performs charging before the charged quantity becomes extremely small by, for example, using the electronic timepiece 1A on the next day, moving the electronic timepiece 1A into a sunny place, or the like, and the charged quantity of the secondary battery can be rapidly recovered. When the battery voltage has recovered, the timing operation is in the state of being continued by the microcomputer 10, and consequently the time display of the electronic timepiece 1A can be adjusted to the present time rapidly without performing any electric wave reception. Moreover, because the CPU of the microcomputer 10 stops the timing operation of the timing section on the basis of the elapse of the warning period for urging a user to perform power generation with the power generating section in the state of the power source voltage being continuously lower than the first level range without changing to be lower than the second level lower than the first level, the timing operation can be stopped before the charged quantity of the secondary battery becomes extremely small.

Moreover, if no charging is performed even by a warning output in the warning period T1 in, for example, in the case where the electronic timepiece 1A is placed beyond the eyeshot of a user, then the CPU of the microcomputer 10 stops the oscillation operation of the oscillating circuit 21 and the operation of the microcomputer 10 to limit the consumption current to be very small before the charged quantity of the secondary battery becomes extremely small, and consequently the charged quantity of the secondary battery can be avoided becoming extremely small even if the electronic timepiece 1A is saved for a long time without being charged. Thereby, even if the electronic timepiece 1A is used after a long period saving, the charged quantity of the secondary battery can be recovered relatively rapidly by the performance of charging. Furthermore, if the charged quantity has been recovered, the time display of the electronic timepiece 1A can be adjusted to the present time rapidly by performing electric wave reception.

Moreover, because the electronic timepiece 1A of the second embodiment is made to reopen the operation of the microcomputer 10 including the timing operation thereof when power generation of a predetermined quantity or more is detected after the movement of the microcomputer 10 of the electronic timepiece 1A to the sleep mode, the electronic timepiece 1A can avoid the disadvantage that the battery voltage greatly falls owing to the insufficiency of the charged quantity at the time of performing an operation consuming a large current after the recovery of the battery voltage to the normal specification region H1 in comparison with the configuration of reopening the operation of the microcomputer 10 when the battery voltage is recovered to the normal specification region H1.

That is, if the battery voltage is measured in the state of consuming almost no currents, then only the battery voltage sometimes becomes high at the state of an insufficient charged quantity, and consequently the battery voltage sometimes greatly falls it an operation consuming a large current is performed at that stage. But it can be avoided that the battery voltage is judged to exceed the voltage YYY' when the charged quantity of the secondary battery is insufficient by a certain degree of the consumption of a current performed by the operation of the microcomputer 10 at the stage of the battery voltage in the low voltage region H2. Thereby, the operation consuming a large current can be executed at the state in which the charged quantity of the secondary battery becomes a certain quantity or more, and the disadvantage of a great fall of the battery voltage owing to an operation consuming a large current at the time of the recovery of the battery voltage to the normal specification region H1 can be avoided.

Incidentally, the present invention is not limited to the embodiments described above, and various modifications can be performed. For example, the warning period T1 has been exemplified to be about one week, the warning period T1 can be suitably changed to be, for example, for a few days or a few months, as long as the span in which the charged quantity of the secondary battery does not fall in greatly, in consideration of the characteristics of the secondary battery and the consumption current of the microcomputer 10.

Moreover, the voltage ranges YYY-YYY' and ZZZ-ZZZ', which are boundaries between each of the regions H1-H3 of the battery voltage, respectively, can be set to suitable voltage values according to the lower limit voltage of the operation of the LSI, the magnitudes of the consumption currents of hand movement and electric wave reception, the characteristics of the secondary battery, and the like.

Moreover, the pulse control circuit 12, the battery voltage detecting circuit 26, the power source monitoring circuit 27, the power generation detecting circuit 29, the ROM 14, and the RAM 15 may be integrated to be one body with the microcomputer 10.

Moreover, although a wrist watch having an analog display section to display a time by rotating a plurality of hands as the time display section thereof has been exemplified in the embodiments, the wrist watch may be the one having a digital display section, such as a liquid display, to digitally display the time.

In addition, the details of the hardware configurations and control procedures shown in the embodiments concretely can be suitably changed without departing from the spirit and scope of the present invention.

What is claimed is:

1. An electronic timepiece, comprising:

a timing section to perform timing of time based on an oscillation signal;

a time display section to display the time based on the timing of the timing section;

an electric wave receiving section to receive an electric wave including a time code;

a power source section to supply electric power;

a power generating section to accumulate electric power in the power source section by performing power generation;

a voltage detecting section to detect a power source voltage supplied from the power source section;

a power generation detecting section to detect the power generation of the power generating section;

a stop control section to: (i) stop a receiving function of the electric wave receiving section and continue a timing operation of the timing section when the voltage detecting section detects that the power source voltage becomes lower than a first level range, and (ii) stop the timing operation of the timing section when a warning period in which a user is urged to perform the power generation by the power generating section has elapsed in a state in which the power source voltage is lower than the first level range without changing to a level lower than a second level range, the second level range being lower than the first level range;

a first start control section to reopen the timing operation of the timing section when the power generation detecting section detects that power generation is at least a predetermined quantity after stopping of the timing section by the stop control section; and a second start control section to make the electric wave receiving section execute reception of the electric wave and make the time display section perform a normal time display operation when the power source voltage becomes higher than the first level range after the stopping of the timing section by the stop control section.

2. The electronic timepiece according to claim 1, wherein the time display section has a plurality of hands to display time, and the electronic timepiece further includes a hand movement control section to stop the plurality of hands at a predetermined position when the power source voltage becomes lower than the first level range.

3. The electronic timepiece according to claim 1, wherein the time display section includes a plurality of hands to display time, and the electronic timepiece further includes a hand movement control section to move the hands intermittently when the power source voltage becomes lower than the first level range.

4. The electronic timepiece according to claim 1, wherein the time display section includes a plurality of hands to display time, and the electronic timepiece further includes a hand movement control section to move the hands irregularly when the power source voltage becomes lower than the first level range.

5. The electronic timepiece according to claim 1, further comprising:

a display section; and a display control section to perform a warning display urging the power generation on the display section when the power source voltage becomes lower than the first level range.

6. The electronic timepiece according to claim 1, further comprising:

a display section; and a display control section to display, on the display section, a period remaining until elapsing of a predetermined time period when the power source voltage becomes lower than the first level range.

7. The electronic timepiece according to claim 5, wherein the display section performs a dot display or a segment display.

8. The electronic timepiece according to claim 6, wherein the display section performs a dot display or a segment display.

9. The electronic timepiece according to claim 5, wherein the display section performs a status display by rotating a hand within a range of a part of a number plate.

10. The electronic timepiece according to claim 6, wherein the display section performs a status display by rotating a hand within a range of a part of a number plate.

11. The electronic timepiece according to claim 1, further comprising:

an oscillating circuit to generate the oscillation signal; and an integrated circuit including the timing section, wherein the stop control section stops operations of the oscillating circuit and the integrated circuit.

* * * * *